US008216009B1

(12) United States Patent
Pelini

(10) Patent No.: US 8,216,009 B1
(45) Date of Patent: Jul. 10, 2012

(54) TILT AND TRIM DEVICE FOR AN OUTBOARD MOTOR

(76) Inventor: Mark Pelini, Valrico, FL (US)

( * ) Notice: Subject to any disclaimer, the term of this patent is extended or adjusted under 35 U.S.C. 154(b) by 504 days.

(21) Appl. No.: 12/584,567

(22) Filed: Sep. 8, 2009

(51) Int. Cl.
*B63H 20/08* (2006.01)
*B63H 20/02* (2006.01)
*B63H 5/125* (2006.01)

(52) U.S. Cl. ..... 440/61 R; 440/61 T; 248/640; 248/642

(58) Field of Classification Search ..... 440/61 T–61 J, 440/61 R; 248/640–643; 138/40–46
See application file for complete search history.

(56) References Cited

U.S. PATENT DOCUMENTS 2,833,312 A * 5/1958 Flick ..... 138/44
4,950,189 A * 8/1990 Tahara et al. ..... 440/61 R

* cited by examiner

*Primary Examiner* — Ajay Vasudeva
(74) *Attorney, Agent, or Firm* — Edward P Dutkiewicz

(57) ABSTRACT

A tilt and trim device for an outboard motor comprising a transom mounting portion with a transom plate and a motor mounting portion with a motor plate. The tilt and trim device having an upper and a lower hydraulic cylinder mounting bracket. A hydraulic cylinder being operatively coupled to a hydraulic pump and hydraulic pump control. The hydraulic cylinder having an upper fluid line and a lower fluid line, with a hydraulic cylinder having a piston contained therein. The hydraulic cylinder having a hydraulic line fluid restrictor.

3 Claims, 3 Drawing Sheets

FIG 3
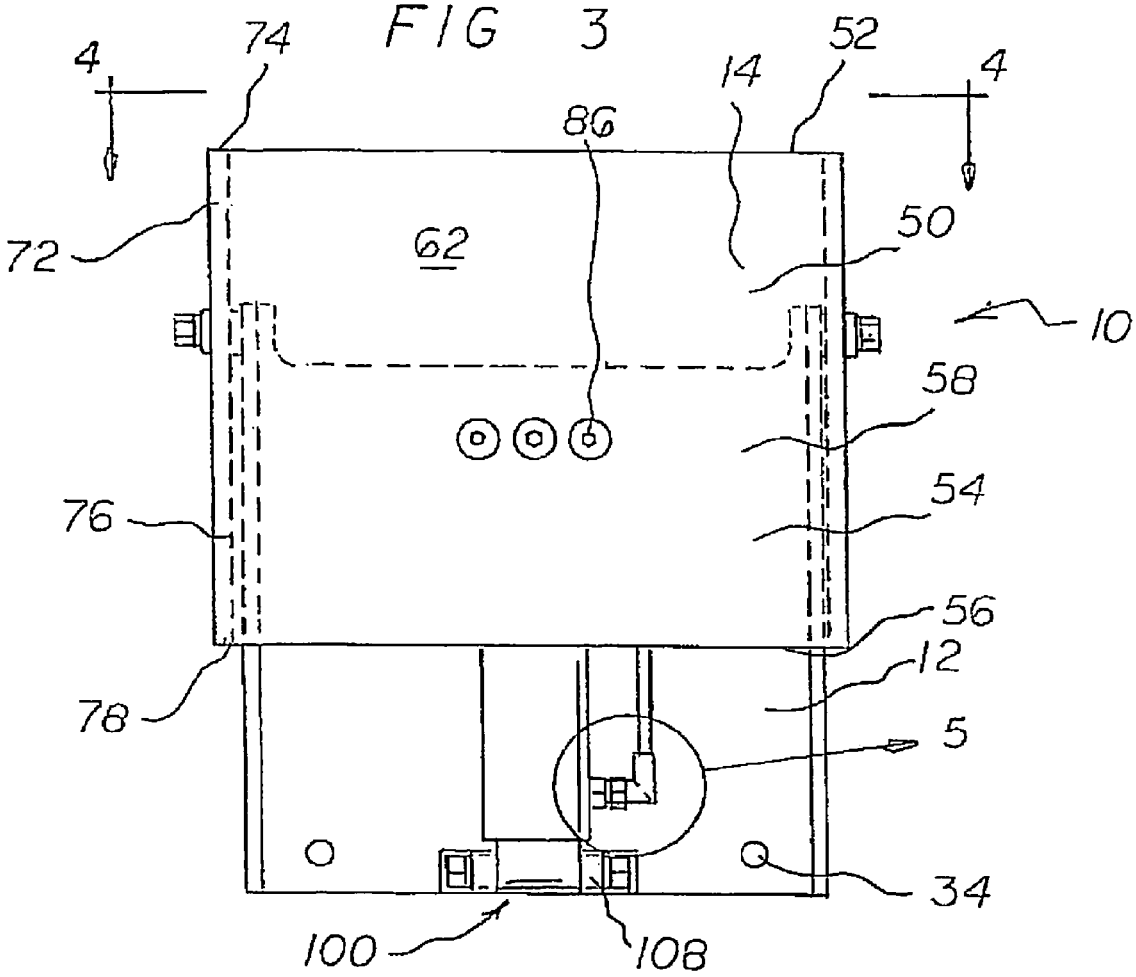
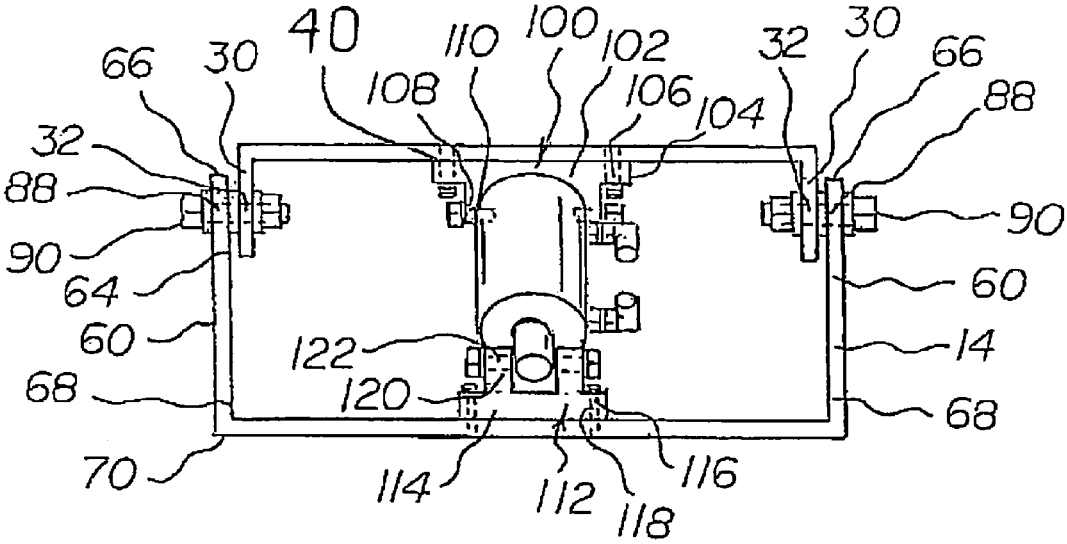
FIG 4

FIG 5
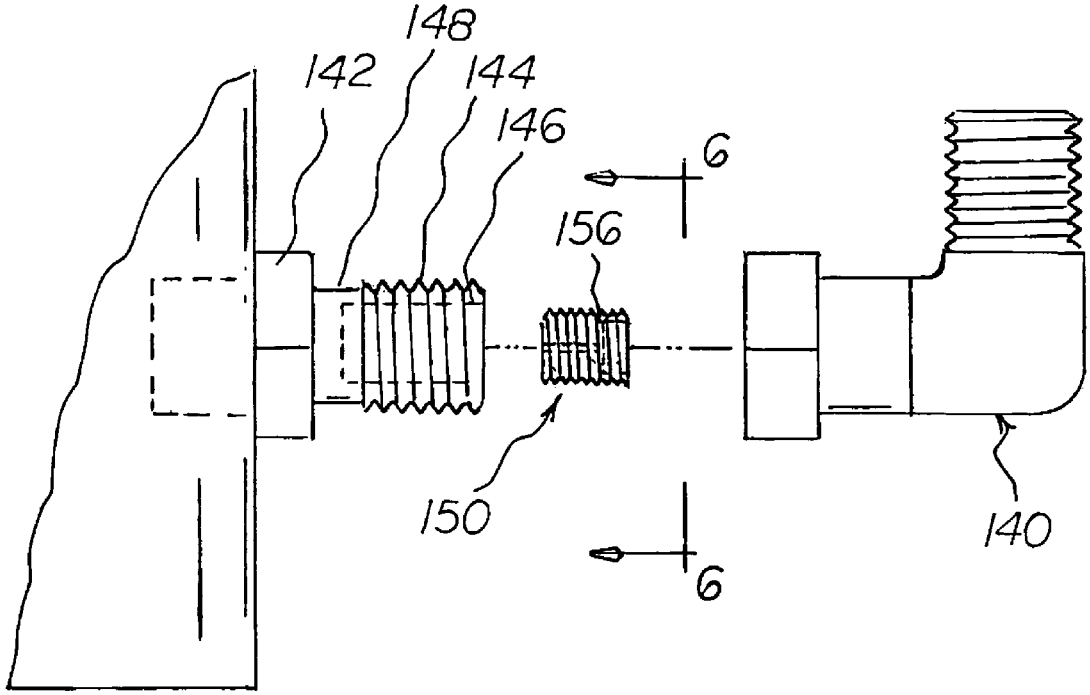
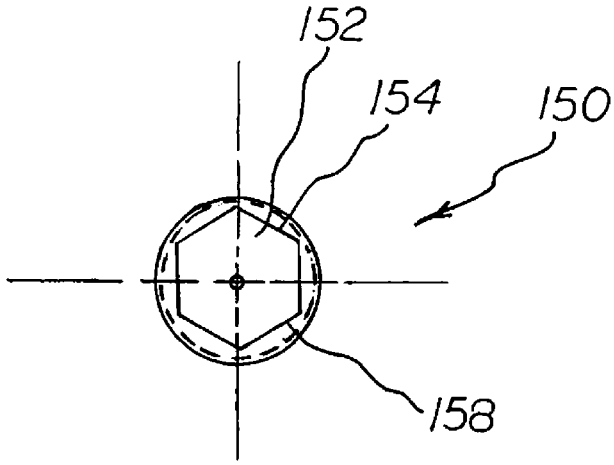
FIG 6

TILT AND TRIM DEVICE FOR AN OUTBOARD MOTOR

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention particularly pertains to a device which may be used to tilt, and/or trim an outboard motor.

DESCRIPTION OF THE PRIOR ART

The use of devices used with outboard motors is known in the prior art. More specifically, devices used with outboard motors previously devised and utilized for the purpose of raising or lowering the depth of the motor are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe tilt and trim device that allows a user to tilt and/or trim an outboard motor.

In this respect, the tilt and trim device according to the present invention substantially departs from the conventional concepts and designs of the prior art, and in doing so provides an apparatus primarily developed for the purpose of tilting and/or trimming an outboard motor.

Therefore, it can be appreciated that there exists a continuing need for a new and improved tilt and trim device which can be used to tilt and/or trim an outboard motor. In this regard, the present invention substantially fulfills this need.

SUMMARY OF THE INVENTION

In view of the foregoing disadvantages inherent in the known types of devices used with outboard motors now present in the prior art, the present invention provides an improved tilt and trim for an outboard motor. As such, the general purpose of the present invention, which will be described subsequently in greater detail, is to provide a new and improved tilt and trim device for an outboard motor which has all the advantages of the prior art and none of the disadvantages.

To attain this, the present invention essentially comprises a tilt and trim device for an outboard motor comprising several components, in combination.

The tilt and trim device for an outboard motor has a transom mounting portion and a motor mounting portion. The transom mounting portion has a generally C-shaped configuration with an upper end, having an uppermost extent and a lower end, having a lowermost extent with a first length there between.

The transom mounting portion has a pair of rearwardly projecting legs with a transom plate having a first width there between. The rearwardly projecting legs each having a pivot hole there through, with the pivot hole being located at the upper end of each of the rearwardly projecting legs. The transom plate of the transom mounting portion has four mounting holes there through, with two of the transom plate mounting holes located at the lower end of the plate. Two of the transom plate mounting holes are located at the upper end of the transom plate.

The lower end of the transom plate has a pair of generally centrally located bracket mounting apertures there through.

The motor mounting portion has a generally C-shaped configuration with an upper end, having an upper extent, and a lower end, having a lower extent. The motor mounting portion has a mid portion with a generally central area having a second length there between.

The motor mounting portion has a pair of forwardly projecting legs with a second width there between. The second width forms a motor plate. The forwardly projecting legs have a forward end with a forward extent, a rearward end with a rearward extent, an upper end with an upper extent, and a lower end with a lower extent. The upper extent of each leg is angled relative to the lower extent of the leg. The forward leg extent is shorter than the rearward leg extent.

A general angle from the upper rearward extent to the forward rearward extent is between about twenty degrees and forty degrees.

The mid portion of the motor plate has a pair of centrally located bracket mounting apertures there through. The forward upper extent of the rearwardly projecting legs of the motor mounting portion each have a pivot hole there through.

The lower end of the transom plate having a generally U-shaped lower hydraulic cylinder mounting bracket. The lower bracket has a base plate and two parallelly oriented mounting tabs. Each of the tabs has a mounting bolt hole there through. The transom plate hydraulic lower bracket also has two tabs for coupling the bracket to the transom. Each of the mounting tabs has a lower cylinder pin aperture there through.

The generally central mid portion motor plate has a generally U-shaped upper hydraulic cylinder mounting bracket. The upper bracket has a base plate and two parallelly oriented mounting tabs. Each of the tabs has a mounting bolt hole there through. The motor plate hydraulic lower bracket also has two forwardly projecting cylinder pin tabs. Each of the pin tabs has a upper cylinder pin aperture there through.

A hydraulic cylinder is operatively coupled to a hydraulic pump and hydraulic pump control. The hydraulic cylinder has an upper fluid line and a lower fluid line. The hydraulic cylinder has a piston contained therein. The lower fluid line comprises a length of tubing, a coupler, and a nipple. The nipple has an outer surface with a thread having a first diameter. The nipple is threadedly coupled to the hydraulic cylinder. The nipple has an interior thread of a second diameter. The second diameter is less than the first diameter.

Lastly provided is a hydraulic line fluid restrictor. The restrictor has a round tubular configuration, with a passageway there through. The restrictor has an interior surface and an exterior surface. The exterior surface has a thread of the second diameter. The interior surface has a hexagonally shaped recess.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tilt and trim device for an outboard motor which has all of the advantages of the prior art devices used with outboard motors and none of the disadvantages.

It is another object of the present invention to provide a new and improved tilt and trim device for an outboard motor which may be easily and efficiently manufactured and marketed.

It is further object of the present invention to provide a new and improved tilt and trim device for an outboard motor which is of durable and reliable constructions.

An even further object of the present invention is to provide a new and improved tilt and trim device for an outboard motor which is susceptible of a low cost of manufacture with regard to both materials and labor, and which accordingly is then susceptible of low prices of sale to the consuming public, thereby making such tilt and trim jack plate economically available to the buying public.

Even still another object of the present invention is to provide a tilt and trim device which may be used to tilt and/or trim an outboard motor.

Lastly, it is an object of the present invention to provide a new and improved tilt and trim device for an outboard motor comprising a device having a transom mounting portion with a transom plate and a motor mounting portion with a motor plate. The tilt and trim device for an outboard motor having an upper and a lower hydraulic cylinder mounting bracket. A hydraulic cylinder being operatively coupled to a hydraulic pump and hydraulic pump control. The hydraulic cylinder having an upper fluid line and a lower fluid line, with a hydraulic cylinder having a piston contained therein. The hydraulic cylinder having a hydraulic line fluid restrictor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear elevational view of the tilt and trim device for an outboard motor.

FIG. 4 is a view taken along line 4-4 of FIG. 3.

FIG. 5 is an exploded view of the hydraulic line an line nipple. Note the placement of the restrictor inside of the nipple.

FIG. 6 is a view taken along line 6-6 of FIG. 5. Note the hexagonally shaped recess, which accommodates an Allen wrench.

The same reference numerals refer to the same parts throughout the various Figures.

DESCRIPTION OF THE PREFERRED EMBODIMENT

Figure 1:
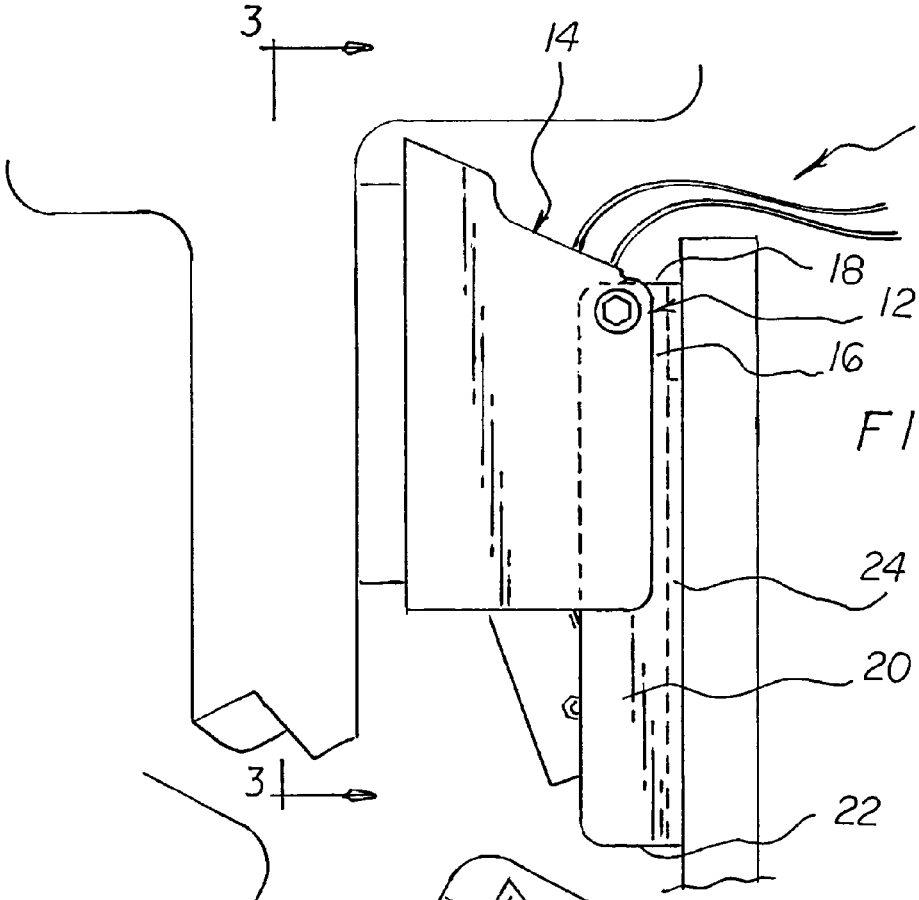
FIG. 1 is a side elevational view of the tilt and trim device for an outboard motor as it is installed on a transom with an attached outboard motor.
Figure 2:
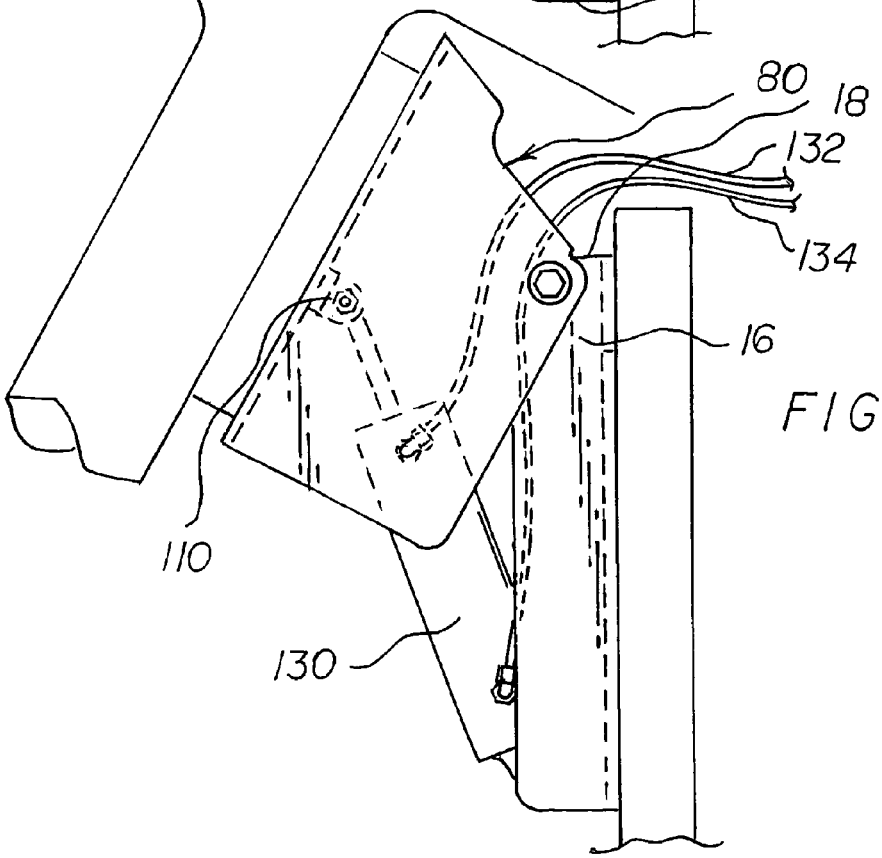
FIG. 2 is a side elevational view of the tilt and trim device for an outboard motor, shown in FIG. 1, with the motor tilted. Note the extension of the hydraulic cylinder shaft. Also note the placement of the pivot pin and the arc of pivot of the motor.

With reference now to the drawings, and in particular to FIG. 1 thereof, the preferred embodiment of the new and improved tilt and trim device for an outboard motor embodying the principles and concepts of the present invention and generally designated by the reference numeral 10 will be described.

The present invention, the tilt and trim device for an outboard motor 10 is comprised of a plurality of components. Such components in their broadest context include a mounting plate, a pivoting plate, a hydraulic cylinder, and a restrictor. Such components are individually configured and correlated with respect to each other so as to attain the desired objective.

A tilt and trim device for an outboard motor 10 comprises several components, in combination.

The tilt and trim for an outboard motor 10 has a transom mounting portion 12 and a motor mounting portion 14. The transom mounting portion 12 has a generally C-shaped configuration with an upper end 16, having an uppermost extent 18 and a lower end 20, having a lowermost extent 22 with a first length 24 there between.

The transom mounting portion 12 has a pair of rearwardly projecting legs 30 with a transom plate having a first width there between. The rearwardly projecting legs each having a pivot hole 32 there through, with the pivot hole 32 being located at the upper end of each of the rearwardly projecting legs 30. The transom plate of the transom mounting portion 12 has four mounting holes 34 there through, with two of the transom plate mounting holes 34 located at the lower end of the plate. Two of the transom plate mounting holes 34 are located at the upper end 16 of the transom plate.

The lower end of the transom plate 20 has a pair of generally centrally located bracket mounting apertures 40 there through.

The motor mounting portion 14 has a generally C-shaped configuration with an upper end 50, having an upper extent 52, and a lower end 54, having a lower extent 56. The motor mounting portion 14 has a mid portion 58 with a generally central area having a second length there between.

The motor mounting portion 14 has a pair of forwardly projecting legs 60 with a second width there between. The second width forms a motor plate 62. The forwardly projecting legs 60 have a forward end 64 with a forward extent 66, a rearward end 68 with a rearward extent 70, an upper end 72 with an upper extent 74, and a lower end 76 with a lower extent 78. The upper extent of each leg 74 is angled 80 relative to the lower extent 78 of the leg. The forward leg extent is shorter than the rearward leg extent.

A general angle from the upper rearward extent to the forward rearward extent is between about twenty degrees and forty degrees.

The mid portion of the motor plate has a pair of centrally located bracket mounting apertures 86 there through. The forward upper extent of the forwardly projecting legs 60 of the motor mounting portion each have a pivot hole 88 there through. There is a pivot pin associated with each pivot hole. The pivot pin is in the form of a bolt 90, but in other variations, other pin types may be used.

The lower end of the transom plate having a generally U-shaped lower hydraulic cylinder mounting bracket 100. The lower bracket 100 has a base plate 102 having two mounting tabs 104. Each of the tabs 104 has a mounting bolt hole 106 there through for coupling the bracket to the transom plate. The transom plate hydraulic lower bracket 100 also has two cylinder pin tabs 108 for coupling the bracket 100 to a hydraulic cylinder. Each of the cylinder tabs 108 has a cylinder mounting pin hole 110 there through.

The generally central mid portion motor plate has a generally U-shaped upper hydraulic cylinder mounting bracket 112. The upper bracket 112 has a base plate 114 and two mounting tabs 116. Each of the tabs 116 has a mounting bolt hole 118 there through. The motor plate hydraulic bracket 112 also has two cylinder tabs 120 for coupling the bracket to the motor plate and to a hydraulic cylinder. Each of the cylinder tabs 120 of the motor plate hydraulic bracket 112 has a cylinder mounting pin hole 122 there through.

A hydraulic cylinder 130 is operatively coupled to a hydraulic pump and hydraulic pump control (not shown but well known in the art). The hydraulic cylinder has an upper fluid line 132 and a lower fluid line 134. The hydraulic cylinder 130 has a piston contained therein (not shown but well known in the art). The lower fluid line comprises a length of tubing, a coupler 140, and a nipple 142. The nipple 142 has an outer surface with a thread 144 having a first diameter. The nipple 142 is threadedly coupled to the hydraulic cylinder 130. The nipple 142 has internal surface having an interior thread 146 of a second diameter. The internal surface forms a passageway 148 through the nipple 142. The second diameter is less than the first diameter.

Lastly provided is a hydraulic line fluid restrictor 150. The restrictor 150 has a round tubular configuration, with a passageway 152 there through. The restrictor 150 has an interior surface 154 and an exterior surface 156. The exterior surface 156 has a thread of the second diameter. The interior surface 154 has a hexagonally shaped recess 158 which is configured to receive and mate with a hex head wrench, commonly known as an "Allen" wrench. The configuration allows the restrictor 150 to be threadedly inserted into the internal thread 146 of the nipple 142, thereby forming a passageway restriction through the passageway of the nipple 142.

The word hexagonally is used to describe a six sided recess. The angles of the recess may be rounded or flattened, meaning that the edges of the recess are not contemplated to have exact angles. It is sufficient that the recess is configured so as to be able to be turned in and turned out, using commonly available tools, such as an Allen wrench. A six sided recess is used in the preferred embodiment, but any type of engagement, such as two sided, three sided, four sided of a multi-sided wall configuration may be employed.

An variation of the restrictor 150 is a passageway without an Allen wrench shaped recess, but, instead, the restrictor 150 uses a constant diameter recess with a slotted end, so as to allow placement with a screwdriver. In this configuration, the hydraulic line coupler, once attached to the nipple 142, would retain the restrictor 150 in position.

The present invention uses the angled upper extent of the forwardly projecting legs 80 of the motor portion to gain advantage over the prior art. By the use of the angled upper extent, the location of pivoting is moved downward. This allows the tilt and trim system to maintain the structural proportions necessary to hold the motor to the transom without fear of breakage and, more importantly, it allows for a shortened radius of motor movement. The radius of motor movement is defined as the distance between the pivot point and the propeller. The shortening of the motor pivot length allows the motor to be trimmed more effectively while maintaining the approximate depth of the propeller in the water. If necessary, the motor can, of course, be tilted the full extent, thereby raising the propeller above the lower part of the hull of the boat, protecting the propeller from damage caused by the propeller striking the bottom.

In conjunction with the lowering of the pivot point of the device, the hydraulic line nipple 142 contains a restrictor 150. The restrictor 150 acts to lower the hydraulic fluid flow to the cylinder 130, making fine adjustment of the position of the motor easy to achieve. The restrictor 150 allows the use of the system with other commercially available, and widely used, hydraulic pumps and controls. In essence, the restrictor allows for the use of commonly used hydraulic pumps and controls to "fine tune" the placement of the propeller, relative to the boat hull and the bottom of the body of water the boat is being navigated in.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tilt and trim device for an outboard motor plate comprising:

a transom mounting portion with a transom plate and a motor mounting portion with a motor plate the transom mounting portion and the motor mounting portion being operatively coupled;

a lower end of the transom plate having a lower hydraulic cylinder mounting bracket;

a central mid portion of the motor plate having an upper hydraulic cylinder mounting bracket;

a hydraulic cylinder being operatively coupled to a hydraulic pump and hydraulic pump control, the hydraulic cylinder having an upper fluid line and a lower fluid line, the hydraulic cylinder having a piston contained therein;

a hydraulic line fluid restrictor;

the transom mounting portion having a generally C-shaped configuration with an upper end having an uppermost extent and a lower end having a lowermost extent and a first length there between;

the motor mounting portion having a generally C-shaped configuration with an upper end having an upper extent and a lower end having a lower extent and the mid portion with a generally central area having a second length there between;

the lower bracket having a generally U-shaped configuration with a base plate and two parallelly oriented mounting tabs;

the upper bracket having a generally U-shaped configuration with base plate and two parallelly oriented mounting tabs;

the hydraulic cylinder lower fluid line comprising a length of tubing and a coupler and a nipple, the nipple having an outer surface with a thread having a first diameter, the nipple being threadedly coupled to the hydraulic cylinder; and the restrictor having a round tubular configuration with a passageway there through, the restrictor having an interior surface and an exterior surface, the exterior surface having a thread of the second diameter;

the transom mounting portion having a pair of rearwardly projecting legs forming a transom plate having a first width there between;

the motor mounting portion having a pair of forwardly projecting legs with a second width there between with the second width forming a motor plate, the second width of the motor plate being greater than the first width;

each of the tabs of the lower bracket having a mounting bolt hole there through, the transom plate hydraulic lower bracket also having two rearwardly projecting cylinder pin tabs with each of the pin tabs having a lower cylinder pin aperture there through;

with each of the tabs of the upper bracket having a mounting bolt hole there through, the motor plate hydraulic lower bracket also having two forwardly projecting cylinder pin tabs with each of the pin tabs having a upper cylinder pin aperture there through;

the hydraulic line nipple having an interior thread of a second diameter with the second diameter being less than the first diameter; and the restrictor interior surface having a hexagonally shaped recess.

2. The tilt and trim device for an outboard motor as described in claim 1 further comprising:

the rearwardly projecting legs each having a pivot hole there through with the pivot hole being located at the upper end of each of the rearwardly projecting legs with each pivot hole having an associated pivot pin; and the forwardly projecting legs each having an upper end with an upper extent, each forward projecting leg having pivot hole there through with the pivot hole being located on the upper end of each of the forwardly projecting legs, each pivot hole having an associated pivot pin.

3. The tilt and trim device for an outboard motor as described in claim 1 further comprising:

the transom plate of the transom mounting portion having four mounting holes there through with two of the transom plate mounting holes being located at the lower end of the plate and two of the transom plate mounting holes being located at the upper end of the transom plate, the lower end of the transom plate having a pair of generally centrally located bracket mounting apertures there through; and each forwardly projecting leg also having forward end with a forward extent and a rearward end with a rearward extent and a lower end with a lower extent, the upper extent of each leg being angled relative to the lower extent of the leg with the forward leg extent being shorter than the rearward leg extent with the general angle from the forward leg upper extent to the forward leg rearward extent being between about twenty degrees and forty degrees, the mid portion of the motor plate having a pair of centrally located bracket mounting apertures there through, the forward upper end of the forwardly projecting legs of the motor mounting portion each having a pivot hole there through.

* * * * *